US005603413A

United States Patent [19]

Mitchum, Jr.

[11] Patent Number: 5,603,413

[45] Date of Patent: Feb. 18, 1997

[54] SORTATION METHOD FOR TRANSPARENT OPTICALLY ACTIVE ARTICLES

[75] Inventor: Samuel T. Mitchum, Jr., Columbia, S.C.

[73] Assignee: Wellman, Inc., Johnsonville, S.C.

[21] Appl. No.: 299,550

[22] Filed: Sep. 1, 1994

[51] Int. Cl.[6] ..... B07C 5/342

[52] U.S. Cl. ..... 209/580; 209/588; 209/938; 250/226

[58] Field of Search ..... 209/522, 523, 209/524, 552, 555, 556, 559, 576, 577, 580, 581, 585, 588, 639, 938, 939; 250/223 B, 226; 356/240, 406, 407

[56] References Cited

U.S. PATENT DOCUMENTS

| | | | |
|---|---|---|---|
| 4,172,397 | 10/1979 | Herbert . | |
| 4,278,538 | 7/1981 | Lawrence et al. | 209/581 |
| 4,351,437 | 9/1982 | Long | 209/585 X |
| 4,373,638 | 2/1983 | Schapper | 209/639 X |
| 4,919,534 | 4/1990 | Reed | 250/225 X |
| 5,141,110 | 8/1992 | Trischan et al. | 209/588 X |
| 5,150,307 | 9/1992 | McCourt et al. | 209/580 X |
| 5,303,037 | 4/1994 | Taranowski | 250/226 X |
| 5,335,791 | 8/1994 | Eason | 209/588 |
| 5,344,026 | 9/1994 | Booth et al. | 209/588 X |
| 5,443,164 | 8/1995 | Walsh et al. | 209/588 X |

FOREIGN PATENT DOCUMENTS

| | | | |
|---|---|---|---|
| 263015 | 4/1988 | European Pat. Off. | 209/588 |
| 2198662 | 6/1988 | United Kingdom . | |

OTHER PUBLICATIONS

EG&G Reticon, LC1922 Dual Color Modular Line Scan Camera, pp. 28–33 (Oct. 1990).

*Primary Examiner*—William E. Terrell
*Assistant Examiner*—Tuan Nguyen
*Attorney, Agent, or Firm*—Bell, Seltzer, Park & Gibson, P.A.

[57] ABSTRACT

A method of and apparatus for sorting plastic items is disclosed. The method comprises the steps of transmitting polychromatic light from a source through each individual item; detecting the quantity of light of a first color passing through each individual item with a detector opposed to the source as a stream of the items is successively directed past the source and the detector; detecting the quantity of light of a second color passing through each individual item with the detector, wherein the second color is different from the first color; and selectively removing individual items from the stream, the removal being based upon a comparison of the quantity of light of the first color detected and the quantity of light of the second color detected.

40 Claims, 4 Drawing Sheets

SORTATION METHOD FOR TRANSPARENT OPTICALLY ACTIVE ARTICLES

FIELD OF THE INVENTION

This invention relates generally to plastics recycling, and more specifically relates to the separation of mixtures of colored and clear transparent articles made of the same plastic.

BACKGROUND OF THE INVENTION

Within the last several years, public interest in the recycling of plastics has grown significantly. The primary reason for the increased public awareness is the non-biodegradable nature of many plastics; the chemical stability of plastics that makes their use in products attractive also prevents their decomposition in landfills after use. As such, the public is demanding that these plastic products be recycled into new products rather than being transported to and dumped in a landfill.

Plastic bottles are a prolific source of plastic waste, and thus are a primary target for recycling. Plastic bottles are used as containers for such products as carbonated beverages, which generally are bottled in polyethylene terephthalate (PET) bottles, milk and household cleaning products, which are bottled predominantly in high density polyethylene (HDPE), and other household goods, which are bottled in polyvinyl chloride (PVC), polypropylene (PP), polycarbonate (PC) and polystyrene (PS). Bottles of all of these plastic materials generally are collected from the end users as a group, either by a household or by a waste collector, are partially crushed, and are delivered to a reprocessor as bales of crushed bottles. To effectively separate all of the bottles in such a group so that the fractions resulting therefrom are useful based on current uses of plastics, a mixture of bottles should be separated into single-material fractions. Often these fractions are separated further based on bottle color.

Mixtures of plastic items can be separated by a number of automated methods. One general technique that appears promising sorts plastic bottles based on the manner in which the material comprising each bottle affects an electromagnetic beam transmitted therethrough. As different plastic materials affect a beam in a distinct and measurable manner, the material comprising the bottle can be identified. The beam may be affected by the transmissivity of the bottle, see, e.g., EPO Publication No. 0 291 959, to Giunchi et al; by the crystallinity or birefringence of the material, see, e.g., U.S. Pat. No. 5,141,110 to Trischan et al., the color of the bottle, see U.S. Pat. No. 4,919,534 to Reed et al., or by other characteristics.

The accuracy of methods employing light transmission to sort bottles by material type and color can be affected by the amount of surface contamination on the bottle. It is not uncommon for individual bottles to vary in the degree of surface contamination they collect prior to sortation. This is particularly true for bottles collected from geographically diverse sites, which are often governed by different local regulations that influence the condition in which bottles are provided.

Typically, sortation methods based on light transmission measure the amount of light that passes through the bottle; the bottle is sorted based on whether the amount of light passing through the bottle exceeds a predetermined threshold. The amount of surface contamination present on a bottle influences the amount of light that passes through the bottle and thus reaches the detector. If a bottle is particularly heavily laden with surface contaminants, the light may be blocked to such a degree that the bottle is incorrectly sorted. For example, a clear PET bottle passes more light than a green PET bottle, particularly if the light is directed through a red filter prior to passing through the bottle. However, a dirty clear bottle may carry surface contaminants that block light passage to such a degree that it will appear—incorrectly—to the detector to be colored. Under such circumstances, the clear bottle will be incorrectly sorted with the colored bottles.

This problem is exacerbated when the stream contains bottles of multiple colors. For example, although the large majority of PET bottles are clear or green, amber and blue bottles are also used and thus appear in sortation streams. Not surprisingly, amber and blue bottles have different light transmissivities than green or clear bottles. As a result, contamination on amber or blue bottles can also cause them to be incorrectly sorted.

The prior art in this field is silent on methods for accurately sorting both clean and dirty bottles. Accordingly, a first object of the present invention is to provide a method for accurately separating a mixture of individual items made of the same transparent plastic material into a colored fraction and a clear fraction irrespective of the degree of contamination of the bottles.

A second object of the present invention is to provide an apparatus for performing the separation.

SUMMARY OF THE INVENTION

These and other objects are satisfied by the present invention, which as a first aspect provides a method of separating individual plastic items from a mixture of individual plastic items. Each of the individual items is formed predominantly of a single type of plastic, but the items are present in at least two different colors of that plastic. The method comprises the steps of: transmitting polychromatic light from a source through each individual item; detecting the quantity of light of a first color passing through each individual item with a detector opposed to the source as a stream of the items is successively directed past the source and the detector; detecting the quantity of light of a second color passing through each individual item with the detector, wherein the second color is different from the first color; and selectively removing individual items from the stream, the removal being based upon a comparison of the quantity of light of the first color detected and the quantity of light of the second color detected. Preferably, the mixture comprises plastic bottles, and more preferably comprises clear, green, and amber PET bottles. With such a mixture, it is preferred that the detector detect the amounts of green and blue light transmitted through each bottle, as such detection effects the sortation of green and amber bottles from the stream while retaining clear bottles.

A second aspect of the present invention is an apparatus for sorting a mixture of individual plastic items as described above. The apparatus comprises: a polychromatic light source; a detector positioned opposite the light source for detection of light passing through each plastic item passing between the light source and the detector; control means for receiving signals from the detector and selectively generating an ejection signal; and ejection means associated with the control means for ejecting an item from the stream. The detector comprises first means for detecting light of a first color passing through each individual item, second means for detecting light of a second color passing through each individual item, and means for converting the detected light of the first color and the detected light of the second color into a first electrical signal and a second electrical signal. These signals are then passed to the control means for processing. Preferably, the detector is a line-scan camera and is configured to detect the amount of blue and green light passing through the item.

DETAILED DESCRIPTION OF THE PREFERRED EMBODIMENT

The present invention will be described more particularly hereinafter with reference to the accompanying drawings. The invention is not intended to be limited to the illustrated embodiment; rather, this embodiment is intended to fully and completely disclose the invention to those skilled in this art.

The present invention is directed at a method of and apparatus for sorting a mixture of plastic items of different colors made predominately of the same material. The present method and apparatus provide a system that can easily and quickly sort clear items from transparent items of at least one color, and preferably a plurality of different colors, irrespective of the degree of contamination on the items. In particular, the illustrated invention is useful in sorting green PET bottles, which comprise the vast majority of colored PET bottles, from a stream containing a mixture of clear and colored PET bottles. More preferably, the invention can be employed to sort both green and amber PET bottles, which are the second most common of the colored PET bottle types, from a mixture of clear and colored PET bottles.

Figure 1:
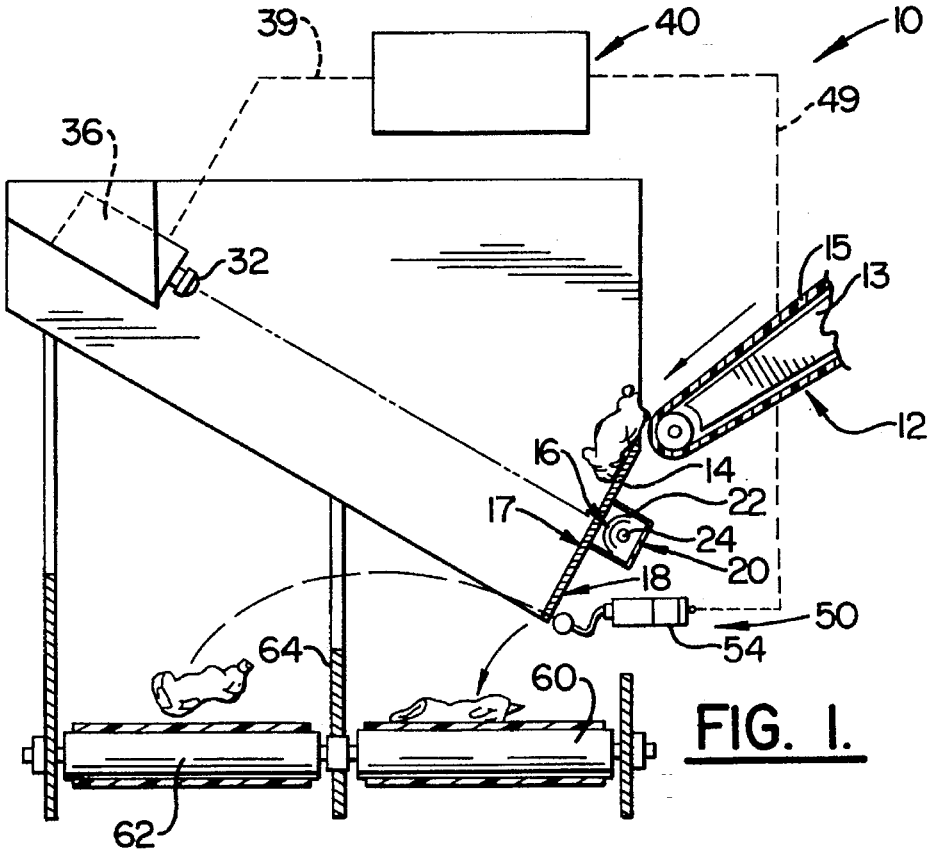
FIG. 1 is a side elevation view of the sorting apparatus.

Referring now to the drawings, a sorting apparatus, designated broadly at 10, is shown in FIG. 1. The sorting apparatus 10 comprises a presentation unit 12 for supplying at least one stream of bottles, a lamp assembly 20, a red-blue-green line scan camera assembly 30, a camera-ejector interface unit 40, and an ejection assembly 50.

The presentation unit 12 of the illustrated embodiment comprises an acceleration conveyor 13 and a slide plate 14. The acceleration conveyor 13 includes an arcuate, downwardly sloping upper surface 15 upon which individual bottles slide prior to detection. The arcuate shape of the upper surface 15 is preferred because a bottle sliding thereon tends to accelerate and thus separate itself from other bottles in the stream. The slide plate 14 is positioned downwardly from and adjacent the lower edge of the acceleration conveyor 13. Preferably, the slide plate 14 resides and slopes so that the upper edge of its upper surface 15 merges smoothly with the lower portion of the upper surface 15 of the acceleration conveyor 13. In the present embodiment, the slide plate 14 is oriented at an angle of approximately 45 degrees to horizontal; however, the slide plate may be angled between 0 and 90 degrees, and preferably is angled between 30 and 60 degrees, to horizontal and still be suitable for use with the present invention.

Both the acceleration conveyor 13 and the slide plate 14 are sufficiently wide to receive five separate streams of bottles without any interference between the streams. Equipment that debales bottles delivered to a sortation plant and separates them into individual streams for sortation (examples of which are described in detail in co-assigned U.S. Pat. No. 07/850,850, the disclosure of which is incorporated by reference in its entirety) provides five segregated streams to the upper end of the acceleration conveyor. Although the current embodiment describes a sortation unit 10 that has the capacity to sort five segregated streams, those skilled in this art will appreciate that the conveyor 13 and the slide plate 14 can be configured to receive a single stream or a plurality of streams and be suitable for use with the invention.

A color detection slot 16 extends horizontally across the center portion of the slide plate 14. In the present embodiment, the color detection slot 16 is approximately 0.375 inch high and approximately 40 inches wide, although any opening or series of openings through which light from the lamp assembly 20 can pass to the camera assembly through an item to be sorted would be suitable. A series of horizontally aligned 0.1 inch diameter blast apertures 19 that extend through the thickness of the slide plate 14 are located across the lower edge portion of the slide plate 14.

Those skilled in this art will appreciate that although the illustrated presentation unit 12 is preferred, any means that presents at least one stream of individual items to the lamp assembly 20 and the camera assembly 30 for detection is suitable for use with this invention. Exemplary alternative presentation means include other varieties and configurations of stationary conveyors, belt conveyors, apparatus that produce a falling stream of articles, and the like. It is also intended that this invention encompass combinations of these presentation means. The slide plate 14 is preferred because it combines the speed, efficiency of presentation, and consistency of presentation rate that a gravitating stream offers while simultaneously providing a surface that controls the distance between the detector 30 and each item to be sorted.

The lamp assembly 20 is mounted on the lower surface 18 of the slide plate 14. The lamp assembly 20 comprises an elongated housing 22 and a fluorescent bulb 24 mounted therein that produces white fluorescent light. The housing 22 is mounted to the slide plate 14 so that the bulb 24 is in noncontacting adjacent relation to the color detection slot 16. It will be understood by those skilled in this art that although the fluorescent bulb 24 is illustrated herein, the present invention may include any light source that can provide a polychromatic light beam of sufficient intensity that it can pass through the material of the item to be sorted and be detected by the camera assembly 30. As used herein, a "polychromatic light beam" means a light beam that includes light of multiple wavelengths, usually within the visible light spectrum, although light fully outside the visible spectrum, such as infrared or ultraviolet, could also be employed. Preferably, the beam is a white light beam, which as used herein means a beam that includes light of essentially all of the wavelengths within the visible light spectrum, although it will be understood from the disclosure herein that as few as two frequency bands could suffice; An exemplary bulb for providing a white light beam is a 60 inch fluorescent lamp available from GBE-Legg, Richmond, Vir.

Figure 3:
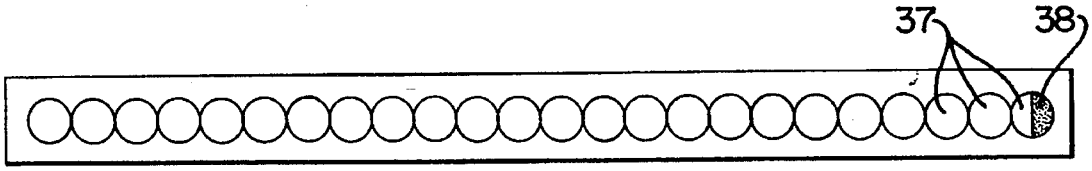
FIG. 3 is an enlarged view of the pixel pattern of the red-green-blue line scan camera.

The red-blue-green camera assembly 30 comprises a red-blue-green line scan camera 36 and a lens 32 on the viewing end thereof. The camera 36 is positioned so that the lens 32 can focus on an item as it passes over the color detection slot 16 of the slide plate 14. A glass filter (not shown) is mounted between the lens 32 and the slide plate 14; this filter reduces the amount of red light reaching the lens 32. The camera 36 (model TL-2600RGB, available from Pulnix, America, Inc., Sunnyvale, Calif.) includes a linear array of detecting photodiodes 37 (FIG. 3) that are positioned within the camera to receive light passing from the lamp assembly 20 through an item and the camera lens 32. Each of the photodiodes 37 is protected by a wavelength filter 38 (only one of which is shown in FIG. 3). Each filter 38 is configured to block the passage of all light except that of a certain wavelength range; in this embodiment, the filters allow the passage of wavelength ranges corresponding to either red, green, or blue light; however, filters permitting the passage of other wavelength ranges may be advantageously employed. Because of the presence of the filters 38, the photodiodes 37 are able to detect only light of the wavelength (and thus color) permitted by their respective filters 38. In this embodiment, the photodiodes 37 and filters 38 are arranged to create an alternating and repeating pattern red-green-blue detecting pattern of individual photodiodes 37 (FIG. 3). The Pulnix camera disclosed above includes 2592 individual photodiodes 37, although those skilled in this art will appreciate that virtually any number of diodes, at least two different sets of which are capable of sensing different wavelengths of light, would be suitable for use with this invention. Further, the alternating linear photodiode pattern is preferred, but the photodiode arrangement can be manipulated based on individual need and preference. The linear array of the line scan camera is preferred due to the increased processing speed inherent to a linear array of photodiodes, but those skilled in this art will appreciate that any means for simultaneously detecting the amount of two different wavelength ranges of light passing through an article, such as a full screen video camera, can be used with the present invention.

Figure 4:
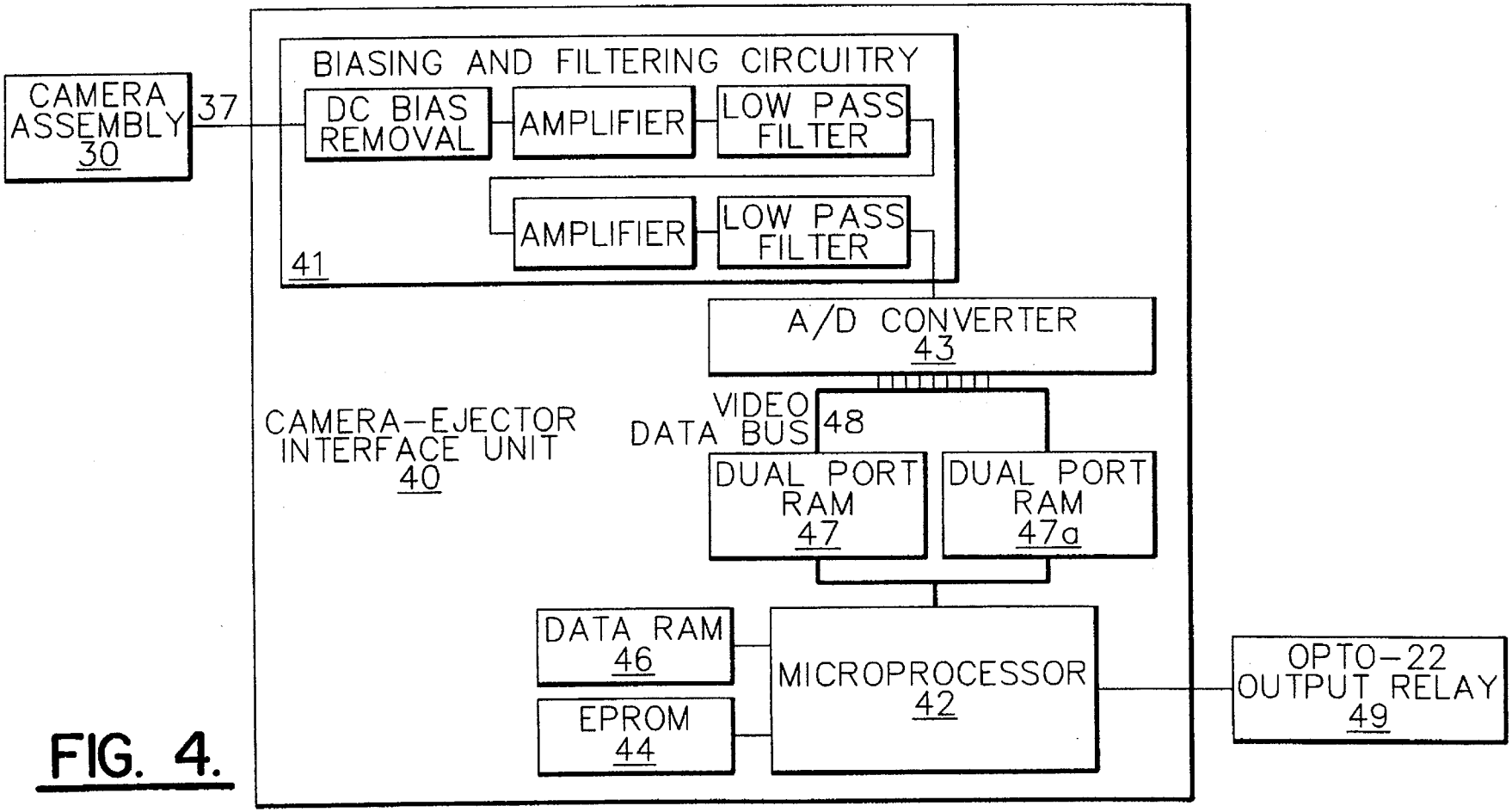
FIG. 4 is a schematic diagram illustrating the interface unit of the sorting apparatus.

As shown schematically in FIG. 4, the red-green-blue camera assembly 30 is electrically connected through a shielded cable 39 (exempified by Pulnix No. 12P05FM) to the camera-ejector interface unit 40. The interface 40 comprises a 68HC11F 1 microprocessor 42 (Motorola, Inc., business address) that includes an electrically erasable programmable memory (EEPROM) unit (not shown), a 32K×8 erasable programmable read-only memory (EPROM) unit 44, a 32K×8 random access memory (RAM) unit 46, input bias circuitry 41, an eight bit analog-to-digital converter 43, and two 4K×8 dual-ported RAM units 47, 48.

The interface 40 is configured so that the output video signal from the camera assembly 30 is amplified, filtered to remove high frequency noise, and rebiased by the analog circuitry 41: The resultant analog voltage signal travels to the 8-bit analog-to-digital (A/D) converter 43, which transforms the signal into a sequence of 8 digit binary numbers, each of which is a coded representation of the filtered light intensity of a specific photodiode 37 on the camera 36. This digitized video data is continually produced by the A/D converter 43 and transmitted via data bus 48 for storage in one of the two dual-ported RAM units 47, 47*a*. Each of these units 47, 47*a* is capable of storing the data for a complete line scan (2592 photodiodes) and providing the data to the microprocessor 42 for processing and generation of an ejection signal for the ejection assembly 50.

Figure 2:
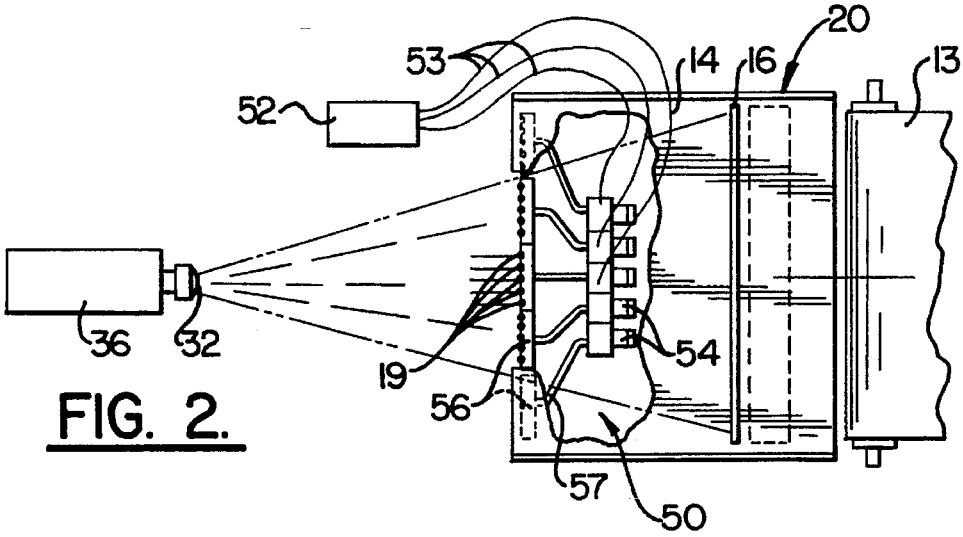
FIG. 2 is a cutaway plan view of the sorting apparatus showing the configuration of the ejector apparatus.

The interface 40 is electrically connected via an output relay cable 49 to the ejection assembly 50, which removes colored bottles from the stream after their detection by the camera interface circuitry 40. The ejection assembly 50 (FIGS. 1 and 2) comprises a pressure tank 52, five air valves 54, and ten blast nozzles 56. The pressure tank 52 is fluidly connected with hoses 53 to each of the air valves 54 and maintains a constant pressure therein. A pressure of about 50 to 60 psi within the tank 52 is preferred for the ejection of PET bottles from a stream. Each of the quintet of air valves 54, which are mounted beneath the arcuate conveyor 13, is electrically connected to the interface 40 through an output relay cable 49. Each of the valves 54 is then fluidly connected by a T-conduit 57 to the inlets of each of a pair of blast nozzles 56. Each blast nozzle 56 extends from its inlet to an elongated rectangular outlet positioned beneath and adjacent a section of apertures 19 of the slide plate 14. The detection slot 16, camera 36, interface unit 40, air valves 54, and blast nozzles 56 are interconnected so that an item detected at a particular widthwise section of the detection slot 16 (i.e., an item traveling as part of a particular segregated stream) will receive an air blast emanating from the nozzle 56 providing pressurized air to the corresponding section of the blast apertures 19. Thus the sortation "lanes" created by the debaling and separating equipment referenced above are retained during sorting and ejection.

A retained bottle belt conveyor 62 resides directly beneath the lower edge of the slide plate 14; this conveyor leads to a retained bottle processing area. An ejected bottle conveyor 60 is positioned adjacent the edge of the retained bottle belt conveyor 62 positioned away from the sortation unit 10; this conveyor leads to a processing area for ejected bottles. A vertical dividing wall 64 separates the conveyors to prevent nonejected bottles from bouncing onto the retained bottle belt conveyor 64.

Prior to operation of the embodiment of the sortation unit 10 illustrated in FIGS. 1–4, the EEPROM 42*a* of the microprocessor 42 is calibrated for the desired color or colors of items to be sorted. This is performed by transmitting light through a single wall thickness of a colored item. Light passing through an item during operation would be passing either through a colored item having two colored walls or a clear bottle having no colored walls; therefore a single wall thickness of an item would provides a meaningful approximate threshold level of colored light for colored transparent items. The EEPROM 42*a* records the amount of light of a first color and of a second color and stores each in memory. The amount of light of the first color denotes the memory address in the EEPROM 42*a* at which the value of light of the second color is stored. To complete the set of values stored in the EEPROM 42*a*, the item wall can be exposed to the camera for varying durations to simulate the light-obscuring effect of surface contaminants; each set of values is stored so that the values corresponding to the light of the second color is indexed in memory by the value of the light of the first color. Alternatively, single wall thicknesses of items having different levels of contamination can be used to calibrate the EEPROM 42*a*, or the values can be manually entered.

The choice of colors to be stored in the EEPROM 42*a* can vary with the colors of the items to be sorted. It is preferred for the sortation of green and amber PET bottles to store green and blue light transmission values in the EEPROM 42, as for each of these bottle colors the green light to blue light ratio is considerably higher than that of clear bottles. If the stream contains only green and clear bottles, it has been shown that green and red light values can be used, as the green light to red light ratio for green bottles is also considerably higher than that of clear bottles. However, those skilled in this art will appreciate that any set of two different light colors that are transmitted in different ratios for two or more different item colors can be used with the present invention.

The sorting of amber and green bottles from a stream containing clear, green and amber bottles commences as the stream of bottles travels along the arcuate conveyor 13 and begins to slide down the slide plate 14. As each bottle passes the detection slot 16, light passes from the bulb 24 through the detection slot 16 and the bottle to the camera 36. The blue and green photodiodes 37 of the camera 30 detect the amounts of blue and green light passing through the bottle. The signals are transmitted via the cable 39 as voltages to the interface 40, where they are amplified, filtered, and rebiased by the circuitry 41, then converted to digital signals in the A/D converter 43. As the A/D converter 43 fills one of the dual-ported RAM units 47, 47*a*, the microprocessor 42 processes the data stored in the other dual-ported RAM during the previous video line scan. In its processing, the microprocessor 42 matches the value of the blue signal to the memory location corresponding to the magnitude of blue light stored in the EEPROM 42*a* during the calibration sequence. This memory location in the EEPROM 42*a* stores a green light value detected during the same calibration scan. This green value is compared to the amount of green light detected by the camera 30 during the scan. A detected green value less than or equal to the value stored in the EEPROM 42*a* indicates a clear bottle; accordingly, the ejector assembly 50 is not activated, and the bottle continues down the slide plate 14 and falls onto the retained bottle belt conveyor 62. If instead the detected green value exceeds the value stored in the EEPROM 42*a*, thereby indicating a green bottle, the interface 40 signals the ejector assembly 50 via output relay cable 49 to open the appropriate air valve 54. The interface 40 is configured so that the valve 54 opens immediately and remains open for approximately 0.2 seconds, a duration within which the large majority of bottles will slide from a position adjacent the color detection slot 16 to a position adjacent the blast apertures 19 on the lower edge of the slide plate 14. The opening of the valve causes air to rush from the pressurized pressure tank 52 through the conduit 57, the attached blast nozzles 56, and the apertures 19. The air jet exiting the apertures 19 strikes the bottle and propels it to the ejected bottle belt conveyor 60, which carries it to a green bottle processing area.

Figure 5:
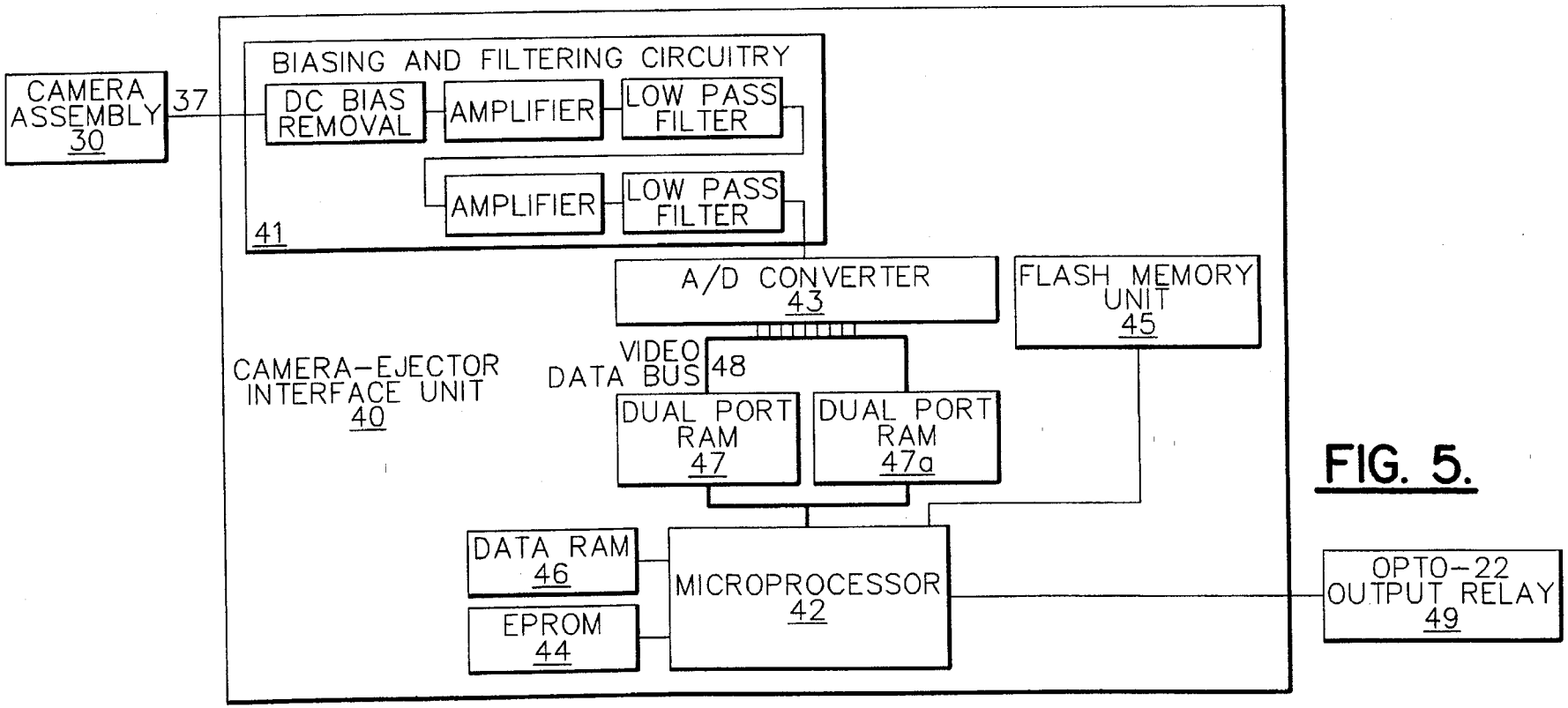
FIG. 5 is a schematic diagram illustrating the interface unit of the sorting apparatus which includes a Flash PROM unit.

As illustrated schematically in an alternative embodiment shown in FIG. 5, the interface 40 may also include a 256K×8 Flash PROM memory 45. The Flash PROM 45 is electrically interconnected with the data bus 48 as it carries data from the RAM units 47, 47*a* to the microprocessor, and is also electrically connected directly to the microprocessor. The Flash PROM 45 comprises an array of memory addresses, each of which can store data that directs the microprocessor 42 whether or not to eject the detected bottle. The memory addresses are labeled to correspond to the digital information on bottle color defined by a series of first, second, and third color components; for this embodiment, these color components correspond to quantities of green, blue, and red light. Thus the specific memory address accessed depends on the quantities of red, blue, and green light detected by the camera 36; as the memory address is accessed, the instructions on ejection stored in that memory address are sent to the microprocessor 42.

The operation of the embodiment of the present invention illustrated in FIGS. 1–3 and 5 begins with a calibration sequence similar to that used for the embodiment of FIGS. 1–4. Light is passed through a single-thickness green bottle wall and detected. The values of red, blue, and green light detected define a color; the digital data that defines the color is utilized as the label for the memory address in the Flash PROM 45. Instructions to eject a bottle are stored at that memory location. The procedure is repeated for varying detection durations to simulate a disparity in bottle cleanliness. In each instance the red, green, and blue values are used to define a different memory address at which ejection instructions are stored.

This entire procedure is repeated for amber blue, and clear bottles. In the memory locations labeled with colors generated from blue and amber bottles, ejection instructions are stored. In memory locations generated from clear bottles, instructions indicating the bottle should not be ejected are stored.

With this embodiment, sortation is quite similar to that described above except for the acquisition of additional color data and the processing of the color data. As a bottle slides down the slide plate 14, the amounts of green, blue, and red light passing through the bottle are detected by the camera 36. These data are converted to voltages and passed as described above to the interface 40, where they are amplified, filtered, rebiased, and converted to digital signals to be stored in RAMs 47 and 47*a* until requested by the microprocessor 42. Once the data is requested, it not only flows to the microprocessor 42, but also to the Flash PROM 45. In the Flash PROM 45, the digital data is compared to and matched most closely with one of the set of predetermined values defining a memory address. The ejection instructions stored at the selected memory location either signal the microprocessor 42 to send an ejection signal to the ejector assembly 50 or signal the microprocessor 42 not to eject the bottle. If the ejector assembly 50 receives an ejection signal, it will activate the appropriate valve 54 to eject the bottle.

The benefit of the present method over a system that relies merely on the transmission of light to sort bottles is clear. A contaminated clear bottle may obscure light passing through it to the detector to a sufficient degree that the bottle appears to the detector to be a colored bottle. However, the present invention compares the amount of light of two different colors that pass through the bottle. The green light/blue light/red light passage ratio differs consistently between colored bottles and clear bottles. As a result, the amount of light transmitted through the bottle (which can be affected by the degree of contamination on the bottle) no longer becomes the determining factor in the sortation; instead, the ratio of the amounts of light of different colors that pass through the bottle (which is largely unaffected by the degree of contamination on the bottle) determines how the bottle is sorted.

The method is not limited to the sortation of only green, blue, and amber bottles from clear. It has been shown that amber bottles, the second most popular bottle color, have a green-to-blue ratio that is consistently considerably higher than that of clear bottles. As a result, both green and amber bottles can be sorted from the stream using the same apparatus.

The invention will now be described in greater detail in the following nonlimiting example.

Comparative Example

Apparatus and Procedure for Testing Sortation of Green and Clear PET with Red-green and Monochrome Detectors To determine the effectiveness of sorting using a red-green line-scan camera, the following comparative experiment was performed. The sorting apparatus consisted of a fluorescent lamp assembly including a 60 inch bulb (GBE-Legg, Richmond, Va.) opposed by a detecting camera. The detecting camera was either a red-green line scan camera (E G & G Reticon, Sunnyvale, Calif.) or a monochrome video camera (GBE-Legg). Each camera was provided with a lens and cables for electrical connection via a shield cable (Opto-22, Temecula, Calif.) with a microprocessor board. The microprocessor was connected through an output relay (Opto-22) to an ejection assembly comprising an air valve (MAC Valves, Inc., Wixom, Mich.) and a blast nozzle (National Recovery Technologies, Inc., Nashville, Tenn.). A slide plate having a 40 inch by 0.25 inch slot was positioned between the lamp assembly and the camera. The blast nozzle was then positioned beneath the lower edge of the slide plate.

During sorting with the line-scan camera, the angle of the slide plate was varied between 30, 45, and 60 degrees to horizontal. During monochromatic sorting, the slide plate angle was maintained at 60 degrees.

The initial composition of a bottle mixture was determined manually. The bottles were then fed individually onto the slide plate and allowed to slide over the viewing slot for detection.

For monochromatic sortation, the camera detected the amount of light passing through the bottle. If that amount exceeded a set threshold, thus indicating a clear bottle, the ejection apparatus would not eject the bottle; however, if the amount of light was less than the threshold, the ejection apparatus would eject the bottle from the stream.

For sortation using the red-green camera, the camera first detected the amount of light passed to the first three red pixels of the camera and compared these values. If the value of the outer pixels of the trio were not within 6 counts (out of a possible 256) of the value of the center pixel of the trio, this indicated that either the edge of the bottle was being detected or that background noise was present, and the adjacent three red pixels were used for detection. The average light value for the three red pixels ultimately selected for detection was averaged and compared to red light values in the EEPROM table of the microprocessor, which had been calibrated with red and green light values through exposure to a single thickness of green PET at different exposure durations. The red light value detected by the camera indicated the memory location of the green light value used for comparison. The amount of light detected at the two green pixels interspaced between the set of three red pixels was averaged, and the average value was compared to the green light value stored in the EEPROM table at the memory location corresponding to the red light value detected above. If the green value detected exceeded the green value in the EPROM table, a green bottle is indicated; if not, a clear bottle was indicated. The microprocessor and ejection apparatus were configured to eject all bottles detected to be green.

Table 1 shows the compositions of the mixtures used in testing.

TABLE 1

| Trial No. | Slide plate angle (°) | Number of Bottles Clear | Green | Total | % Green Bottles |
|---|---|---|---|---|---|
| 1 | 30 | 1320 | 660 | 1980 | 33 |
| 2 | 30 | 2400 | 600 | 3000 | 20 |
| 3 | 30 | 536 | 248 | 784 | 32 |
| 4 | 45 | 1320 | 660 | 1980 | 33 |
| 5 | 45 | 2400 | 600 | 3000 | 20 |
| 6 | 45 | 534 | 239 | 773 | 31 |
| 7 | 60 | 1320 | 660 | 1980 | 33 |
| 8 | 60 | 2400 | 600 | 3000 | 20 |
| 9 | 60 | 525 | 245 | 770 | 32 |
| 10[a] | 60 | 1357 | 680 | 2037 | 33 |
| 11[b] | 60 | 1360 | 692 | 2052 | 34 |
| 12[a] | 60 | 606 | 294 | 900 | 33 |
| 13[b] | 60 | 599 | 300 | 899 | 33 |

[a]Trials with only clean bottles
[b]Trials with only dirty bottles

After sortation, the bottles sorted as green and the bottles sorted as clear were examined. The number of correctly and incorrectly sorted bottles of in each sorted fraction was determined. These results are shown in Table 2.

TABLE 2

| Trial | Ejected Stream (Green) | | | Nonejected Stream (Clear) | | |
|---|---|---|---|---|---|---|
| No. | Green | Clear | Purity | Green | Clear | Purity |
| 1 | 638 | 40 | 94.1 | 22 | 1280 | 98.3 |
| 2 | 565 | 37 | 93.9 | 35 | 2373 | 98.5 |
| 3 | 237 | 19 | 92.6 | 11 | 517 | 97.9 |
| 4 | 639 | 26 | 96.1 | 21 | 1294 | 98.4 |
| 5 | 584 | 25 | 95.9 | 16 | 2375 | 99.3 |
| 6 | 234 | 12 | 95.1 | 5 | 522 | 99.1 |
| 7 | 625 | 40 | 94.0 | 35 | 1280 | 97.3 |
| 8 | 564 | 59 | 90.5 | 36 | 2341 | 98.5 |
| 9 | 228 | 11 | 95.4 | 17 | 514 | 96.8 |
| 10 | 634 | 205 | 75.6 | 46 | 1152 | 96.2 |
| 11 | 657 | 363 | 64.4 | 35 | 997 | 96.6 |
| 12 | 265 | 34 | 88.6 | 29 | 572 | 95.2 |
| 13 | 280 | 147 | 65.6 | 20 | 452 | 95.8 |

Purity for a given fraction was calculated by dividing the number of bottles correctly sorted by the total number of bottles in that fraction.

Figure 6:
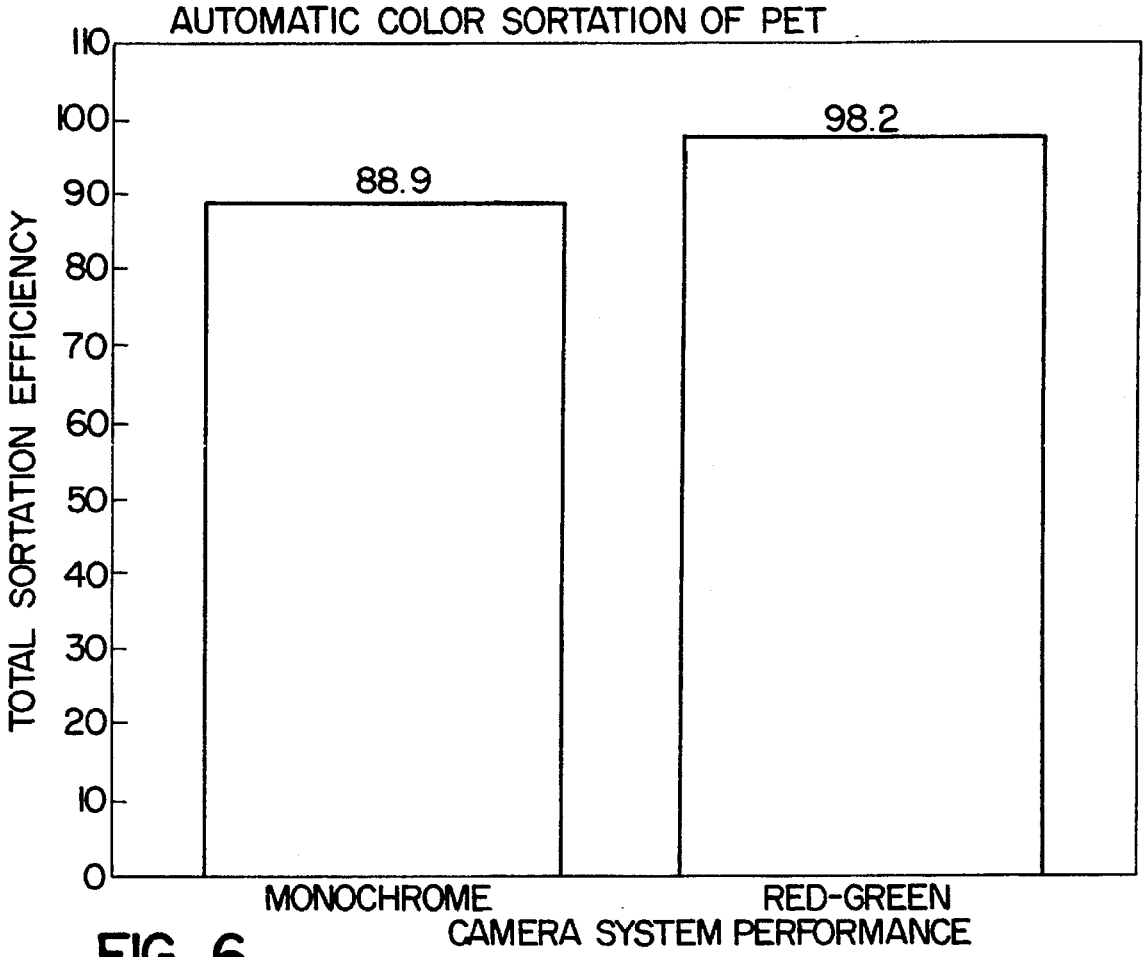
FIG. 6 is a bar graph comparing the sortation efficiency of a red-green line scan camera with a monochrome video camera.

These data indicate that the employment of a red-green camera substantially improves the detection accuracy of this system irrespective of the degree of contamination on the bottle being sorted. The data are summarized in FIG. 6, which plots the total sortation efficiency (defined as the number of bottles directed to the proper fraction divided by the total number of bottles) for a different monochrome camera trial and a red-green camera trial. This graph indicates that use of the red-green detection system instead of a monochrome detector improves sortation efficiency approximately 10 percent and raises efficiency to over 98 percent, which is a much more acceptable production value than that observed for monochrome detection.

The foregoing example is illustrative of the present invention, and is not to be construed as limiting thereof. The invention is defined by the following claims, with equivalents of the claims to be included therein.

That which is claimed is:

1. A method of separating individual plastic items from a mixture of individual transparent plastic items, each of the individual items being formed predominantly of a single type of plastic, but with the items being present in at least two different colors of that plastic, the method comprising:

transmitting white light from a source through each individual item;

detecting the quantity of light of a first color passing through each individual item with a detector opposed to the source as a stream of the items is successively directed past the source and the detector;

detecting the quantity of light of a second color passing through each individual item with the detector, wherein the second color is different from the first color; and selectively removing individual items from the stream based upon a comparison of the quantity of light of the first color detected to the quantity of light of the second color detected.

2. A method according to claim 1, wherein the step of detecting a first color of light comprises detecting the quantity of green light passing through each individual item.

3. A method according to claim 2, wherein said step of detecting a second color of light comprises detecting the quantity of blue light passing through each individual item.

4. A method according to claim 1, wherein said first detecting step and said second detecting step comprise detecting the quantity of light of a first color and the quantity of light of a second color passing through each individual item with a line scan camera.

5. A method according to claim 1, wherein the step of transmitting light comprises transmitting light through a mixture of bottles.

6. A method according to claim 5, wherein the step of transmitting light comprises transmitting light through a mixture comprising polyethylene terephthalate bottles.

7. A method according to claim 6, wherein the step of transmitting light comprises transmitting light through a mixture of bottles comprising green polyethylene terephthalate bottles and clear polyethylene terephthalate bottles.

8. A method according to claim 7, wherein the step of transmitting light comprises transmitting light through a mixture of bottles which further comprises blue polyethylene terephthalate bottles and amber polyethylene terephthalate bottles.

9. A method according to claim 1, wherein said removing step further comprises the steps of:

matching the amount of the light of the first color to a first predetermined value selected from a first set of predetermined values; and comparing the amount of the light of the second color detected to a second predetermined value, said second predetermined value being a member of a second set of predetermined values, the second predetermined value being selected based on the magnitude of the first predetermined value; and removing the item if the amount of light of the second color exceeds the second predetermined value.

10. A method according to claim 9 further comprising, prior to the steps of transmitting light through each item, the steps of:

(a) detecting the amount of light of the first color and of the second color transmitted through a single wall of an item during a first duration; then (b) repeating step (a) for one or more different durations, wherein the amounts of light detected for the first color comprise the first set of predetermined values and the amounts of light detected for the second color comprise the second set of predetermined values.

11. A method according to claim 1 further comprising the step of:

detecting the quantity of light of a third color passing through each individual item with the detector, wherein the third color is different than the first color and the second color;

and wherein said removing step comprises removing individual items from the stream based upon the quantity of light of the first color detected compared to the quantity of light of the second color detected and to the quantity of light of the third color detected.

12. A method according to claim 11 which, prior to the passing step, further comprises the steps of:

establishing a set of predetermined color values, each of which is defined by the respective values of a first color component, a second color component, and a third color component; and designating which predetermined color values of the set of predetermined color values indicate a colored item;

and wherein said selective removing step comprises the steps of:

selecting a predetermined color from the set of predetermined colors based on the quantities of light of the first, second, and third color detected by the detector; and removing items having a predetermined color value which designates a colored item.

13. A method according to claim 12, wherein said selecting step comprises the step of matching the quantities of the first, second, and third colors detected to the first, second, and third color components of a predetermined color value of the set of predetermined color values.

14. A method according to claim 13, wherein the step of detecting a first color of light comprises detecting the quantity of green light passing through each individual item.

15. A method according to claim 14, wherein said step of detecting a second color of light comprises detecting the quantity of blue light passing through each individual item.

16. A method according to claim 15, wherein said step of detecting a third color of light comprises detecting the quantity of red light passing through each individual item.

17. A method according to claim 13, wherein the step of transmitting light comprises transmitting light through a mixture comprising polyethylene terephthalate bottles.

18. A method according to claim 17, wherein the step of transmitting light comprises transmitting light through a mixture of bottles comprising green polyethylene terephthalate bottles and clear polyethylene terephthalate bottles.

19. A method according to claim 18, wherein the step of transmitting light comprises transmitting light through a mixture of bottles which further comprises blue polyethylene terephthalate bottles and amber polyethylene terephthalate bottles.

20. A method according to claim 19, wherein said removing step comprises removing green, blue, and amber polyethylene terephthalate bottles from the stream.

21. An apparatus for separating individual plastic items from a mixture of individual transparent plastic items, each of the individual items being formed predominantly of a single type of plastic, but with the individual items being present in at least two different colors, the apparatus comprising:

a white light source;

a detector positioned opposite said light source for the detection of light passing through each plastic item passing between said light source and said detector, said detector comprising:

(a) first means for detecting light of a first color passing through each individual item;

(b) second means for detecting light of a second color passing through each individual item; and (c) means for converting the detected light of the first color and the detected light of the second color into a first electrical signal and a second electrical signal;

control means for receiving said first and second signals from said first and said second detection means and selectively generating an ejection signal based on a comparison of the magnitude of said first and second electrical signals; and ejection means for removing individual items from the stream operatively associated with said control means.

22. An apparatus according to claim 21, wherein said first detecting means comprises means for detecting the amount of blue light passing through an item positioned between said detector and said source, and wherein said second detecting means comprises means for detecting the amount of green light passing through an item positioned between said detector and said source.

23. An apparatus according to claim 21, wherein said first detecting means and said second detecting means comprise a line-scan camera.

24. An apparatus according to claim 21, wherein said control means comprises:

first means for comparing said first electrical signal with a set of predetermined values and selecting from said set a first predetermined value;

second means for comparing the second electrical signal with a second predetermined value, said second predetermined value being a member of a set of predetermined values and being selected based upon the value of the first predetermined value; and means for activating said ejector means if said second electrical signal exceeds said second predetermined value.

25. An apparatus according to claim 21, wherein said detector further comprises:

third means for detecting the quantity of light of a third color passing through each individual item, wherein the third color is different than the first color and the second color;

and wherein said converting means comprises means for converting the detected light of the first color, the detected light of the second color, and the detected light of the third color into, respectively, a first electrical signal, a second electrical signal, and a third electrical signal;

and wherein said control means comprises means for receiving said first, second, and third signals from said first, second, and third detection means and selectively generating an ejection signal based on a comparison of the magnitude said first, second, and third electrical signals.

26. An apparatus according to claim 25 wherein said control means comprises:

means for storing a set of predetermined color values, each of which is defined by the respective values of a first color component, a second color component, and a third color component;

means for designating which predetermined color values of the set of predetermined color values indicate a colored item; and means for selecting a predetermined color from the set of predetermined colors based on the quantities of light of the first, second, and third color detected by the detector and generating an ejection signal for those predetermined colors of the set of predetermined colors that indicate a colored item.

27. An apparatus according to claim 26, wherein said means for selecting a predetermined color comprises means for matching the quantities of the first, second, and third colors detected to the first, second, and third color components of a predetermined color value of the set of predetermined color values.

28. An apparatus according to claim 27, wherein said means for detecting a first color of light comprises means for detecting the quantity of green light passing through each individual item.

29. An apparatus according to claim 28, wherein said means for detecting a second color of light comprises means for detecting the quantity of blue light passing through each individual item.

30. An apparatus according to claim 29, wherein said means for detecting a third color of light comprises means for detecting the quantity of red light passing through each individual item.

31. A method of separating individual plastic items from a mixture of individual transparent plastic items, each of the individual items being formed predominantly of a single type of plastic, but with the items being present in at least two different colors of that plastic, the method comprising:

transmitting white light from a source through each individual item;

detecting the quantity of light of a first color passing through each individual item with a detector opposed to the source as a stream of the items is successively directed past the source and the detector;

detecting the quantity of light of a second color passing through each individual item with the detector, wherein the second color is different from the first color;

detecting the quantity of light of a third color passing through each individual item with the detector, wherein the third color is different than the first color and the second color; and selectively removing individual items from the stream based upon the quantity of light of the first color detected compared to the quantity of light of the second color detected and to the quantity of light of the third color detected.

32. A method according to claim 31, wherein the step of detecting a first color of light comprises detecting the quantity of green light passing through each individual item.

33. A method according to claim 32, wherein said step of detecting a second color of light comprises detecting the quantity of blue light passing through each individual item.

34. A method according to claim 33, wherein said step of detecting a third color of light comprises detecting the quantity of red light passing through each individual item.

35. A method according to claim 31 wherein said first, second and third detecting steps comprise detecting the quantities of light of the first, second and third colors passing through each individual item with a line scan camera.

36. A method according to claim 31, wherein the step of transmitting light comprises transmitting light through a mixture of bottles.

37. A method according to claim 36, wherein the step of transmitting light comprises transmitting light through a mixture comprising polyethylene terephthalate bottles.

38. A method according to claim 37, wherein the step of transmitting light comprises transmitting light through a mixture of bottles comprising green polyethylene terephthalate bottles and clear polyethylene terephthalate bottles.

39. A method according to claim 38, wherein the step of transmitting light comprises transmitting light through a mixture of bottles which further comprises blue polyethylene terephthalate bottles and amber polyethylene terephthalate bottles.

40. A method according to claim 39, wherein said removing step comprises removing green, blue, and amber polyethylene terephthalate bottles from the stream.

* * * * *